US005267682A

United States Patent [19]

Okouchi

[11] Patent Number: 5,267,682

[45] Date of Patent: Dec. 7, 1993

[54] ADJUSTING MECHANISM FOR ADJUSTING POSITION OF ABUTTING MEMBER IN FASTENER DRIVING DEVICE

[75] Inventor: Yukiyasu Okouchi, Anjo, Japan

[73] Assignee: Makita Corporation, Anjo, Japan

[21] Appl. No.: 903,489

[22] Filed: Jun. 24, 1992

[30] Foreign Application Priority Data

Jun. 24, 1991 [JP] Japan ..... 3-047537[U]

[51] Int. Cl.[5] ..... B25C 7/00

[52] U.S. Cl. ..... 227/151; 227/120; 227/140

[58] Field of Search ..... 227/119, 120, 151, 140, 227/108, 110, 5; 403/104; 411/84, 85, 435, 409; 81/431, 57.37

[56] References Cited

U.S. PATENT DOCUMENTS

| | | | |
|---|---|---|---|
| 907,996 | 12/1908 | Hagen | 411/409 |
| 2,073,958 | 3/1937 | Crosby | 227/151 |
| 2,764,758 | 10/1956 | Schafroth | 227/108 |
| 2,812,515 | 11/1957 | Whitman . | |
| 2,915,754 | 12/1959 | Wandel | 227/5 |
| 3,125,761 | 3/1964 | Adams | 227/151 |
| 3,900,144 | 8/1975 | Hamilton . | |

FOREIGN PATENT DOCUMENTS 57-73077 5/1982 Japan .

*Primary Examiner*—Scott Smith
*Assistant Examiner*—Allan M. Schrock
*Attorney, Agent, or Firm*—Dennison, Meserole, Pollack & Scheiner

[57] ABSTRACT

A fastener driving device includes a body, a driver guide extending downwardly from the body for driving fasteners by a driver, a first abutting member mounted on the driver guide and having a first reference surface for abutment on an edge of a work to be fixed, and a second abutting member having a second reference surface for abutment on an edge of another work which has been previously fixed. An adjusting mechanism is provided for adjusting the position of the second abutting member relative to the first abutting member. The adjusting mechanism includes a support member mounted on the body and supporting the second abutting member in such a manner that the second abutting member is slidably movable along a direction substantially perpendicular to a longitudinal direction of the driver guide. A tightening mechanism is operable for fixing the position of the second abutting member and for permitting movement of the second abutting member. An operation member is provided for operation of the tightening mechanism.

10 Claims, 3 Drawing Sheets

1
2
4
5
6
11
3
19
16
20
15
17
14
13
22
23
10
9
10a
12
W2
7
8
W1

ADJUSTING MECHANISM FOR ADJUSTING POSITION OF ABUTTING MEMBER IN FASTENER DRIVING DEVICE

BACKGROUND OF THE INVENTION

1. Field of the Invention

The present invention relates to an adjusting mechanism for adjusting a position of an abutting member in a fastener driving device and particularly to an adjusting mechanism for adjusting the position of an abutting member used for truing up roofing materials such as asphalt roof shingles.

2. Description of the Prior Art

Generally, in a fastening operation of roofing materials such as asphalt roof shingles, the roofing materials are laid to overlap with the previously fixed roofing material in sequence and are fastened by a nail driven from a nailing machine. In this operation, it is necessary to true up the position of the roofing material to be fixed, relative to the position of the previously fixed roofing material. For this purpose, the nailing device for use with roofing materials normally includes an adjusting device for truing up the positions of the roofing materials.

Japanese laid-Open Utility Model Publication No. 57-73077 discloses an adjusting mechanism including a bolt for applying its one end on a roofing material. The bolt is mounted on a mounting plate formed with a frame of a nailing device at a position below a nail magazine. The position of one end of the bolt is adjusted by a nut engaged with the bolt.

However, with the conventional adjusting mechanism, the adjusting operation involves troublesome steps of loosening the nut, moving the bolt and thereafter tightening the nut.

SUMMARY OF THE INVENTION

It is, accordingly, an object of the present invention to provide an adjusting mechanism which can be simply and easily operated for truing up roofing materials to be fastened by a fastener driving device.

According to the present invention, there is provided an adjusting mechanism in a fastener driving device having a body, a driver guide extending downwardly from the body for driving fasteners by a driver, a first abutting member mounted on the driver guide and having a first reference surface for abutment on an edge of a work to be fixed, and a second abutting member having a second reference surface for abutment on an edge of another work which has been previously fixed, comprising:

a support member mounted on the body and supporting the second abutting member in such a manner that the second abutting member is slidably movable along a direction substantially perpendicular to a longitudinal direction of the driver guide;

a tightening mechanism operable for fixing the position of the second abutting member and for permitting movement of the second abutting member: and an operation member for operation of the tightening mechanism;

whereby the position of the second reference surface can be adjusted relative to the first reference surface.

The invention will become more fully apparent from the claims and the description as it proceeds in connection with the drawings.

DETAILED DESCRIPTION OF THE PREFERRED EMBODIMENT

Figure 1:
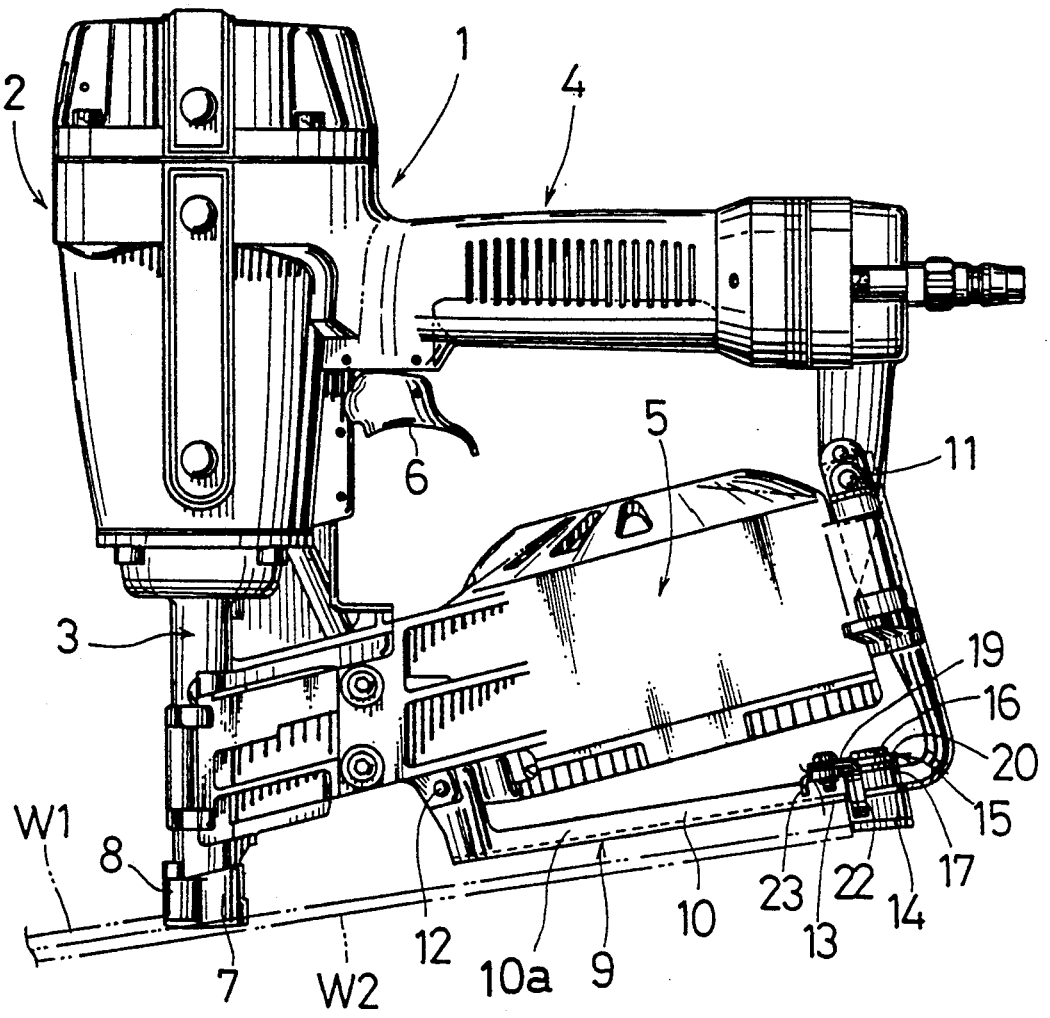
FIG. 1 is a side view of a fastener driving device including an adjusting mechanism according to an embodiment of the present invention.
Figure 2:
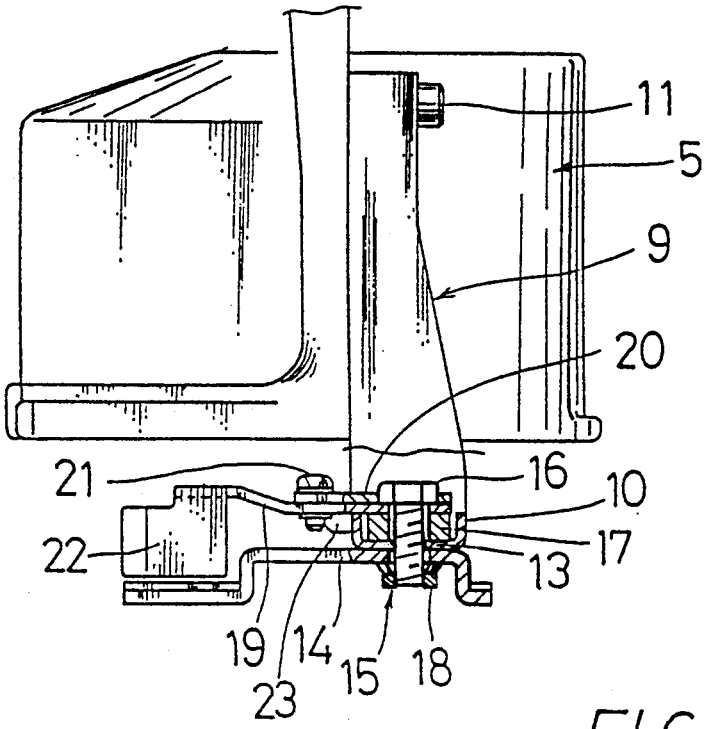
FIG. 2 is an enlarged view of a main part of FIG. 1, with a part broken away.

Referring to FIG. 1, there is shown a fastener driving device 1 including an adjusting mechanism 9 according to an embodiment of the present invention. The fastener driving device 1 has a body 2 within which a piston (not shown) is reciprocally driven by compressed air supplied from an air source (not shown). A driver guide 3 is mounted on the body 2 and extends downwardly from the body 2. The driver guide 3 includes therein a fastener drive track within which a driver (not shown) connected with the piston is driven to eject fasteners fed from a magazine 5 storing fasteners or nails in circular form. A handle 4 is integrally formed with the body 2 and extends substantially horizontally from the middle position of the body 2. A contact arm 7 is slidably mounted on the lower portion of the driver guide 3. When the contact arm 7 is pressed on a work W2 such as a roofing material to be fixed, it is moved upwardly to permit driving of the piston through actuation of a trigger 6 mounted on the body 2. The contact arm 7 has a flat first reference surface 8 formed on the front side of its lower end for abutting on an edge of a work W1 to be fixed next to the work W2.

Figure 5:
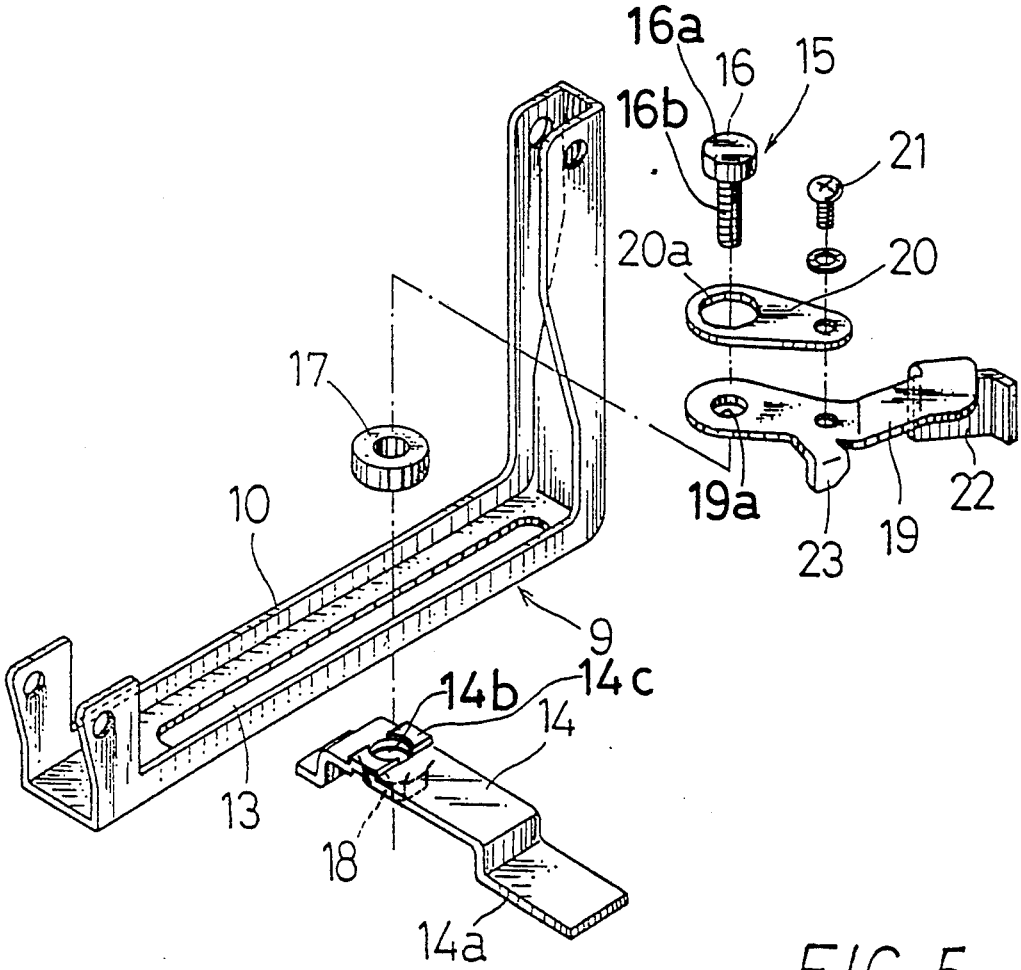
FIG. 5 is an exploded perspective view of main parts of the adjusting mechanism.

A gauge body or a support member 10 has substantially L-shaped configuration and has substantially U-shaped configuration in section as shown in FIG. 5. One end of the support member 10 is connected to a rear end of the handle 4 thorough a screw 11 and the other end of the same is connected to the forward portion of the magazine 5 through a screw 12 in such a manner that the longer side **10*a* of the support member 10 extends substantially in parallel with the handle 4. As shown in FIG. 5, an elongated slot 13 is formed in a longitudinal direction of the longer side 10*a* of the support member 10**.

A plate-like abutting member 14 having substantially crank-like configuration is disposed under the longer side **10*a* of the support member 10 and extends substantially perpendicular thereto. The abutting member 14 has a second reference surface 14*a* for abutting on the edge of the work W2 which has been previously fixed. The position of the abutting member 14 can be adjusted along the elongated slot 13 by a tightening mechanism 15**.

As shown in FIG. 5, the tightening mechanism 15 includes a bolt 16 having a hexagonal head **16*a* and a threaded shank 16*b*. The threaded shank 16*b* is inserted into the elongated slot 13 of the support member 10 and extends downwardly through an opening 14*b* formed in the abutting member 14. The lower end of the threaded shank 16*b* is engaged with a nut 18 fixed to the lower surface of the abutting member 14 below the opening 14*b*. An annular spacer 17** is interposed between the head 16a of the bolt 16 and the support member 10. Further, a plate-like operation member 19 is interposed between the head 16a and the spacer 17 and has one end including an opening 19a through which the threaded shank 16b of the bolt 16 is inserted. The diameter of the opening 19a is larger than that of the threaded shank 16b but is smaller than that of the head 16a. Thus, the operation member 19 is kept between the head 16a and the spacer 17 but is pivotable relative to the bolt 16.

A securing plate 20 has one end formed with a polygonal hole 20a in engagement with the head 16a and is pivotable with the bolt 19. The securing plate 20 is disposed above the operation member 19 in contacting relationship therewith and has the other end fixed to the operational member 19 through a screw 21. Thus, as the operational member 19 is pivoted, the securing plate 20 is also pivoted, so that the operational member 19 can be operated to tighten the bolt 16 so as to fix the position of the abutting member 14 relative to the support member 10 or to loosen the bolt 16 so as to permit movement of the abutting member 14 relative to the support member 10. To prevent rotation of the abutting member 14 relative to the support member 10, a part 14c of the abutting member 14 is projected upwardly to partly engage the elongated slot 13 of the support member 9.

The operation member 19 includes an engaging portion 22 formed at the other end and extending vertically for engagement by fingers of an operator. The operation member 19 further includes a stopper portion 23 extending vertically from the middle portion. The stopper portion 23 limits the pivotal movement of the operation member 19 through abutment on the lateral surface of the longer side 10a of the support member 10 in such a manner that the engaging portion 22 may not position forwardly of the second reference surface 14a.

Figure 3:
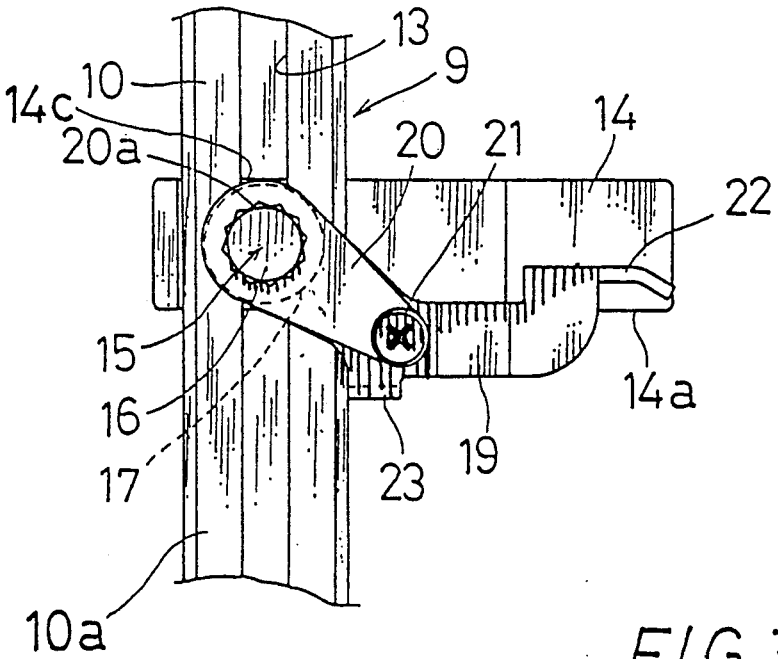
FIG. 3 is an enlarged plan view showing the operation member pivoted to a tightening position.

The operation of the above embodiment will now be described. The distance between the first reference surface 8 of the contact arm 7 and the second reference surface 14a of the abutting member 14 is determined according to the width of the work W and the distance to be overlapped between adjacent works W. Thus, the abutting member 14 is moved relative to the movable member 10 along the slot 13 to a position where the second reference surface 14a is spaced from the first reference surface 8 by such determined distance. The operation member 19 is thereafter pivoted in a forward direction or a direction to tighten the bolt 16, so that the abutting member 14 is pressed on the lower surface of the support member 10. The position of the abutting member 14 is consequently fixed relative to the support member 10. FIG. 3 shows the operation member 19 pivoted to a tightening position.

After the adjusting mechanism 5 has been thus adjusted, the fastener driving device 1 is placed on the previously fixed work W2 in such a manner that the second abutting surface 14a abuts on the rear end of the work W2 as shown in FIG. 1. The work W1 is laid to overlap with the work W2 in such a manner that the rear end of the work W1 abuts on the first reference surface 8. Thus, the work W1 can be properly positioned relative to the work W2. The other works W are sequentially positioned in the same manner, so that each of the works W can be trued up relative to the previously fixed one.

Figure 4:
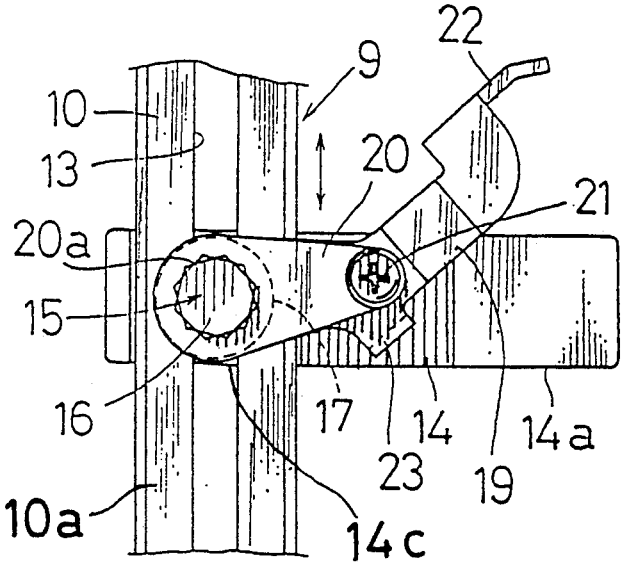
FIG. 4 is a view similar to FIG. 3 but showing the operation member pivoted to a loosening position.

For adjusting the position of the abutting member 14, the operator pivots the operation member 19 from the tightening position shown in FIG. 3 by engaging his fingers with the engaging portion 22 in a reverse direction or in a direction to loosen the bolt 16, so that the abutting member 14 becomes free to move along the support member 10 under the guide of the shank 16b of the bolt 16 in engagement with the elongated slot 13. FIG. 4 shows the operation member 19 pivoted to a loosening position. The operator thereafter moves the abutting member 14 to a desired position, and pivots the operation member 19 to tighten the bolt 16 so as to fix the position of the abutting member 14 in the same manner as described above. Of course, the range of the pivotal movement of the operation member 19 is limited within a range to maintain engagement of the operation member 19 with the shank 16b of the bolt 16.

As described above, in this embodiment, the abutting member 14 can be fixed to the support member 10 and can move relative to the support member 10 through a simple operation of the operation member 19 to pivot the same in the forward direction and the reverse direction, respectively. Therefore, the operation for adjusting the position of the abutting member 14 can be easily made.

Further, since the operation member 19 includes a stopper portion 23 for abutment on the lateral surface of the support member 10 when the operation member 19 has reached the tightening position as shown in FIG. 3, the operation member 19 does not pivot to project from the second reference surface 14a of the abutting member 14 in a direction toward the contact arm 7. Therefore, the operation to position the next work W2 in abutment on the second reference surface 14a of the abutting member 14 can be performed without being prevented by the operation member 19.

While the invention has been described with reference to a preferred embodiment thereof, it is to be understood that modifications or variations may be easily made without departing from the scope of the present invention which is defined by the appended claims.

What is claimed is:

1. An adjusting mechanism is a fastener driving device having a body, a driver guide extending downwardly from the body for driving fasteners by a driver, a first abutting member mounted on the driver guide and having a first reference surface for abutment on an edge of a work to be fixed, and a second abutting member having a second reference surface for abutment on an edge of another work which has been previously fixed; comprising:

a support member mounted on the body for supporting the second abutting member so that the second abutting member is slidably movable along a direction substantially perpendicular to a longitudinal direction of the driver guide, wherein said support member includes an elongated slot extending substantially perpendicular to the longitudinal direction of the driver guide, an operation member for operation of said tightening mechanism, a tightening mechanism operable for fixing the position of the second abutting member and for permitting movement of the second abutting member, wherein said tightening mechanism includes a bolt having a head portion for pivotal operation by said operation member and a shank portion inserted into said elongated slot of said support member and engaged with said second abutting member, said second abutting member is disposed on a side opposite to said head portion of said bolt with respect to said support member; and said operation member including two ends, one end mounted on said bolt and the other end formed with an engaging portion for engagement with the fingers of an operator for pivotal movement by the operator, said one end of said operation member is pivotally fitted on the shank portion of said bolt and is kept between said head portion of said bolt and said support member; a securing plate is disposed above said operation member and engaged with said head portion of said bolt, said securing plate is connected with said operation member in such a manner that said securing plate pivots together with said operation member, whereby the position of the second abutting member can be adjusted relative to the first abutting member.

2. The adjusting mechanism as defined in claim 1 wherein said securing plate is engaged with said head portion of said bolt through a polygonal hole.

3. An adjusting mechanism in a fastener driving device having a body, a driver guide extending downwardly from the body in a longitudinal direction for driving fasteners by a driver, a magazine for storing fasteners, a first abutting member mounted on the driver guide and having a first reference surface for abutment on an edge of a work to be fixed, and a second abutting member having a second reference surface for abutment on an edge of a work which has been previously fixed, said adjusting mechanism comprising:

a support member mounted below the magazine and supporting the second abutting member, the support member including an elongated slot extending substantially perpendicular to the longitudinal direction of the driver guide, the second abutting member being slidably movable along said elongated slot;

a tightening mechanism operable for adjusting the position of said second abutting member relative to said first abutting member, wherein said tightening mechanism includes a bolt having a head portion and a shank portion inserted into said elongated slot of said support member and engaged with said second abutting member, said second abutting member is disposed on a side opposite to said head portion of said bolt with respect to said support member; and an operation member for fixing of said tightening mechanism following adjustment of said second abutting member at a desired distance from said first abutting member, wherein said operation member including two ends, one end mounted on said bolt and the other end formed with an engaging portion for engagement with fingers of an operator for pivotal movement by the operator.

4. The adjusting mechanism as defined in claim 3 wherein said support member is L-shaped, one end of the support member is connected with said magazine for storing fasteners mounted on the driver guide, the other end is connected with a handle formed integrally with and extending substantially in parallel with the handle.

5. The adjusting mechanism as defined in claim 3 wherein a spacer is interposed between said head portion of said bolt and said support member.

6. The adjusting mechanism as defined in claim 3 wherein said second abutting member includes a projection formed for engagement in the elongated slot of said support member so as to prevent said second abutting member from rotation relative to the support member.

7. The adjusting mechanism as defined in claim 3 wherein said operation member includes a stopper portion for preventing said second abutting member from moving toward the first abutting member to a position beyond the second reference surface.

8. The adjusting mechanism as defined in claim 3 wherein said one end of said operation member is pivotally fitted on the shank portion of said bolt and is kept between said head portion of said bolt and said support member; a securing plate is disposed above said operation member and engaged with said head portion of said bolt; and said securing plate is connected with said operation member in such a manner that said securing plate pivots together with said operation member.

9. The adjusting mechanism as defined in claim 8 wherein said securing plate is engaged with said head portion of said bolt through a polygonal hole.

10. The adjusting mechanism as defined in claim 3 wherein the first abutting member is a contact arm mounted to be slidably movable on the driver guide for selectively permitting driving operation of the fasteners.

* * * * *